United States Patent [19]

Quenot

[11] 3,968,670

[45] July 13, 1976

[54] SECURITY KEY-RING

[75] Inventor: Michel Quenot, Besancon, France

[73] Assignee: Stanley-Mabo, Besancon, France

[22] Filed: Jan. 20, 1975

[21] Appl. No.: 542,441

[30] Foreign Application Priority Data

Feb. 2, 1974 France ..... 74.04209

[52] U.S. Cl. ..... 70/456 R; 242/107

[51] Int. Cl.[2] ..... A47G 29/10

[58] Field of Search ..... 70/456–459; 24/3 K, 230.5 BA, 230.5 AC, 255 AS; 224/5 F; 242/107 R

[56] References Cited

UNITED STATES PATENTS

| | | | |
|---|---|---|---|
| 1,818,514 | 8/1931 | Whitaker | 224/5 F |
| 2,732,148 | 1/1956 | Lummis | 242/107 R |
| 3,062,478 | 11/1962 | Adachi | 242/107 R |

*Primary Examiner*—Robert L. Wolfe

*Attorney, Agent, or Firm*—Prutzman, Hayes, Kalb & Chilton

[57] ABSTRACT

The invention is concerned with a security key-ring meant in particular for prison turn-keys.

It is composed of two half-shells, one male and one female, fitting together, that contain in the space between them an automatic roll-up mechanism with a strong recall spring in its rolled-up position, which mechanism pulls along a solid small chain sliding over the upper edge of the housing and reliably connected with a ring carrying the set of keys, having as a special feature that the rear face of the housing shows a metal fastening assembly in the shape of a clasp which holds it securely to the housing on a plane for its support.

The invention can be expected to interest all key-ring manufacturers and those of small linear measuring instruments.

7 Claims, 8 Drawing Figures

7
14
15
10
12
11
18
19
20
17
V

VII
VII

SECURITY KEY-RING

The invention is concerned with a high-capacity safety key-ring meant in particular for collectivities and prison guards.

The classic key-ring devices in existence at this time are numerous and of a great variety. They are usually composed by a decorative part used for advertising or anything else in the shape of the plate, of small reproductions of objects or persons or some particular gadget.

This kind of key-ring is made for a small number of small flat keys.

Also known are key-rings with a larger capacity that may serve for larger hollow keys. These key-rings are usually made for collectivities. They are formed by a central flat ring and two coils of steel ring lying longitudinally along the central ring, held together by the spring force of the steel.

These rings in themselves have no other purpose than to keep several keys together on a common support and do not offer any safety against theft of accidental loss of the assembly.

So as to avoid these disadvantages, these rings were attached to housings, key bunches or other independent containers so as to have the assembly better in hand.

The disadvantages persisted and it has been tried to connect it to a holder that is attached to the user, for instance to his belt.

The purpose of these attachments have as their essential purpose to avoid losing the keys and frequently are of a very weak nature and not very safe, very much as are the knots that attach their ends to the supports and to the ring.

This way there came out safety key-rings in the USA in the shape of a flat cylindric housing provided on its edge with an opening containing a tube from which a chain comes out, fastened with its free end in the classic form to a key-ring.

The housing has on one of its faces a support in the shape of an inverted U, the end of each of the branches of which is attached to the mentioned face so as to leave a rectangular space between the face and the central branch of the support so the housing can be slipped on the belt to carry it.

These constructions contain in their interior a drum on which the chain rolls up, fastened to one end of the steel band coil spring which causes the chain to come back to its rolled-up position.

The coil spring is fastened to the rotation axil, one end of which is held by transversal blocking or some other means.

This way, there is always a connection between spring and chain, and between the spring and the drum and the housing.

A too fast movement or too strong traction on the chain when it is entirely drawn out will frequently cause jamming or internal blocking, making dismantling of the housing necessary to re-establish functioning.

The purpose of this invention is to remedy these disadvantages. The object is a safety key-ring, in particular for prison turn-keys, formed by two half-shells, one male and one female, one fitting into the other, containing in their interior an automatic roll-up mechanism with a strong pullback spring that draws a sliding string, running over the upper edge of the housing and being fastened to a key-ring having as its particular feature that the rear face of the housing contains a fastening device in the shape of a clasp which is fastened to a flat exterior support securely connected to the housing.

These key-rings present multiple advantages, in particular with respect to safety (1) in normal use for the housing is solidly anchored to the belt of the guard by the presence of the clasp; (2) in the case of an attempt to seize the keys by aggression it suffices to release the key-ring to make it return rapidly to its position of departure against the housing; (3) the string connecting the ring with the housing may be reinforced so as to impose considerable time and complicated means to cut it; (4) the fastening of the spring to the drum is done independently from that of the string so as to avoid any blocking or abnormal functioning; and (5) the housing may be held to the belt, attaching it by its clasp or by slipping it on the belt between the clasp frame and the rear wall of the housing. This double use will considerably enlarge its use and could make it useful even to the private person.

In addition, this key-ring proves to be practical, agreeable to use, light and, by its construction itself, of an interesting cost price.

The following description specifies the object of the invention as well as the drawings relative to it which are:

Figure 1:
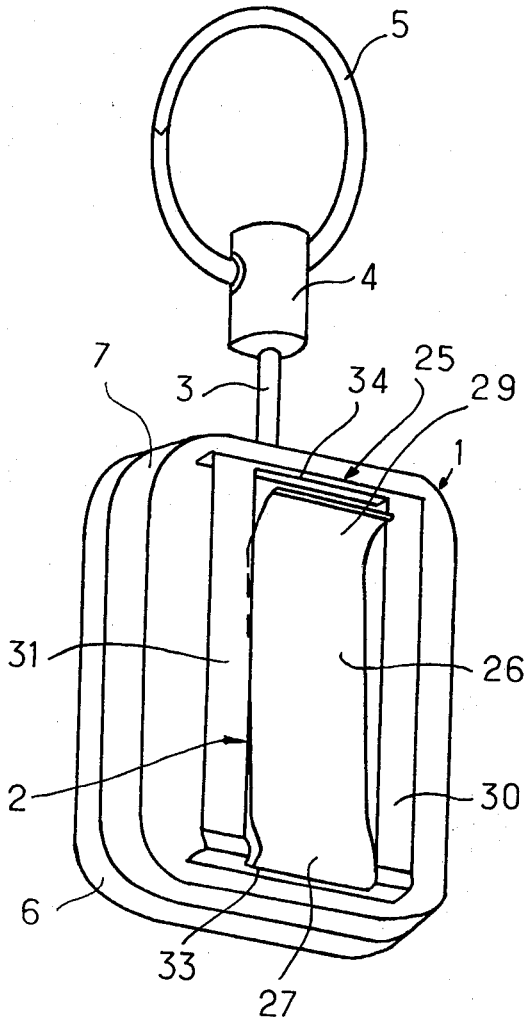
FIG. 1 is a perspective view of the assembly of the key-ring as per the invention.
Figure 2:
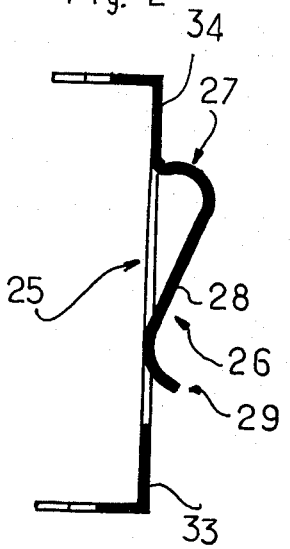
FIG. 2 is a profile view of the clasp and its anchoring device in the housing.
Figure 3:
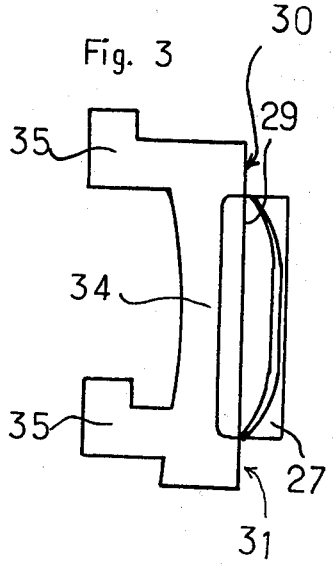
FIG. 3 is a plan view of the clasp and its anchoring device in the housing.
Figures 4, 5:
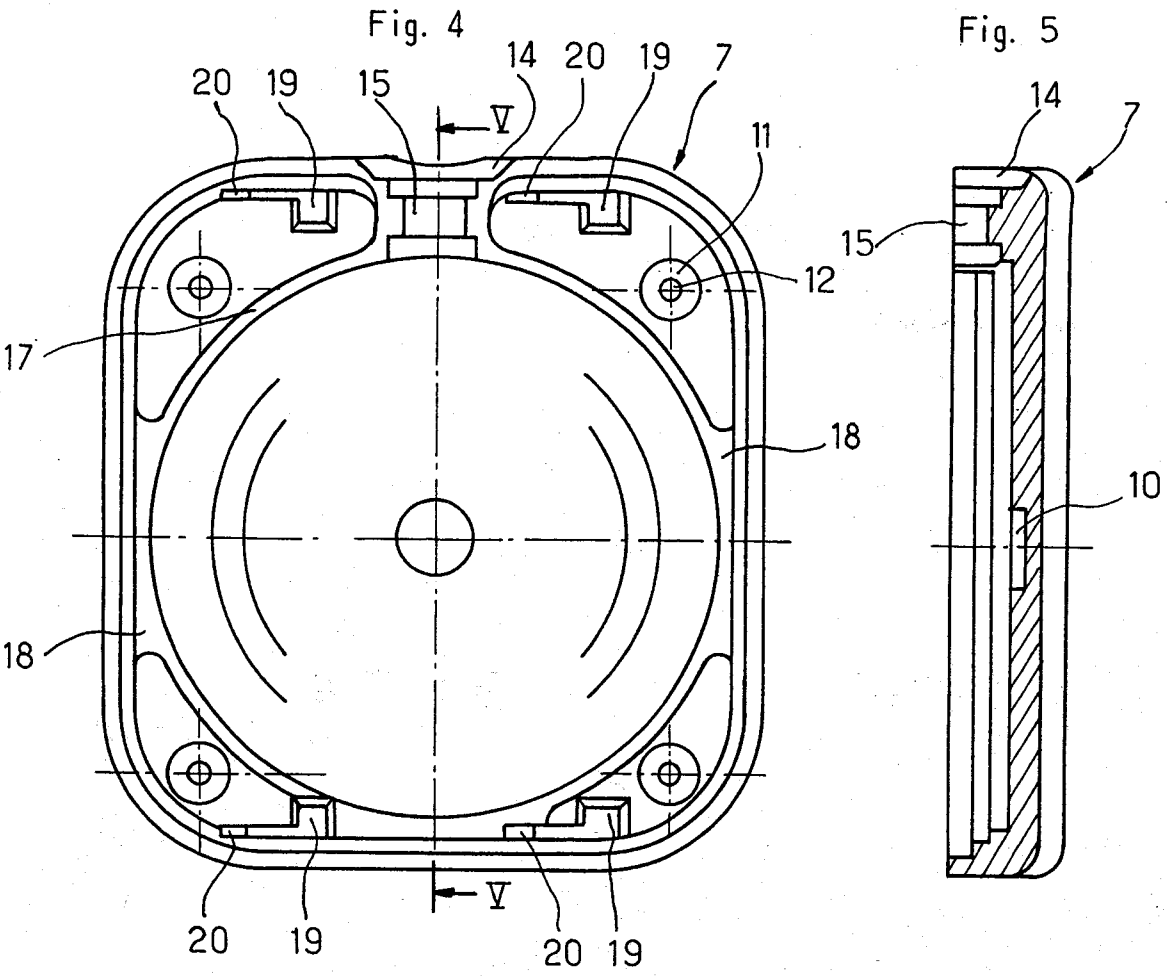
FIG. 4 is a plan view of the interior of the female half-shell.
FIG. 5 is a transverse sectional view through the female half-shell taken along the line V—V of FIG. 4.
Figures 6, 7, 8:
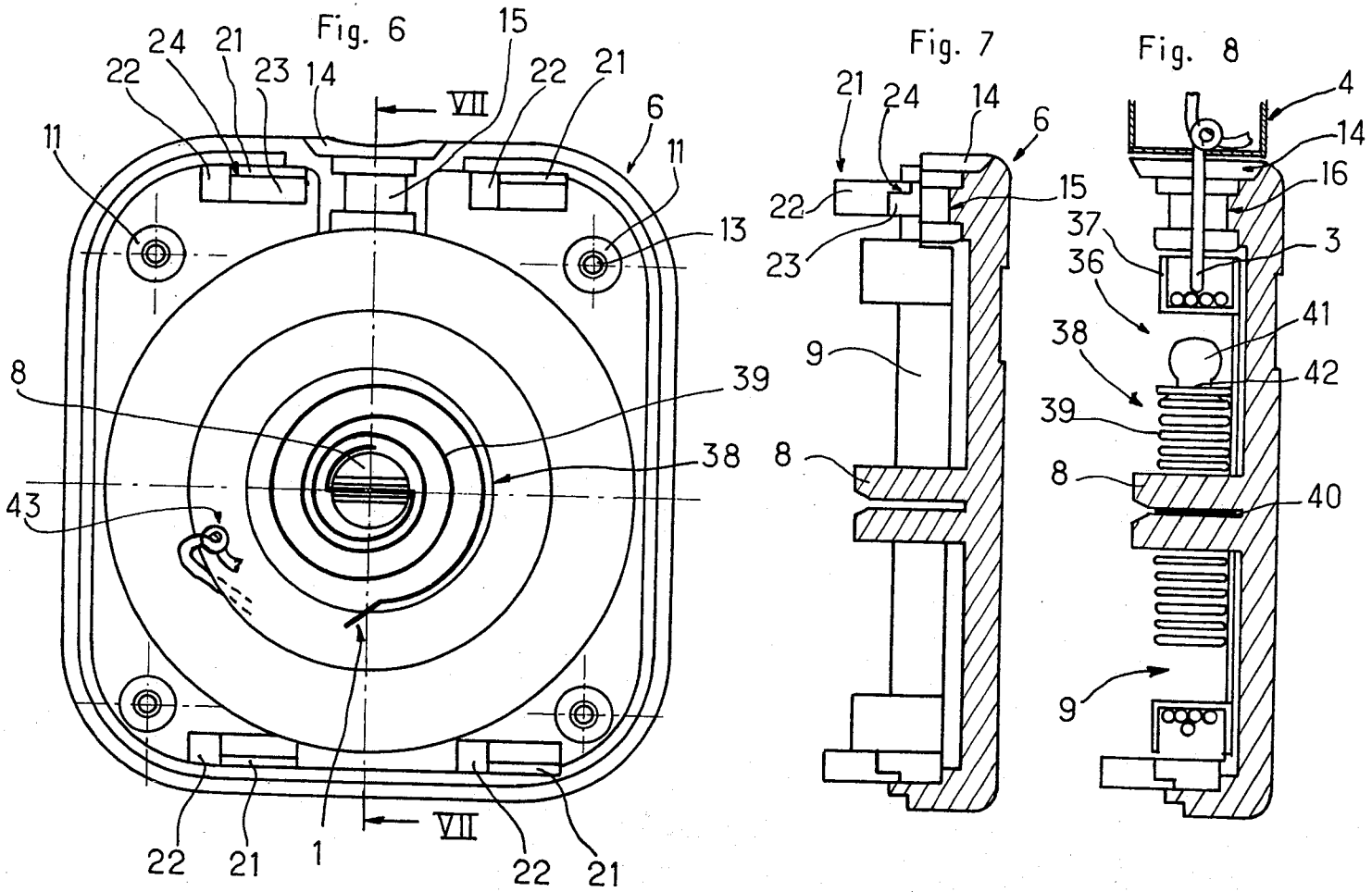
FIG. 6 is a plan view of the male half-shell.
FIG. 7 is a transverse sectional view through the male half-shell taken along the line VII—VII of the FIG. 6.
FIG. 8 is a transverse sectional view similar to FIG. 7 through the drum and its pull-back mechanism in rolled-up position.

The following description is in no way limitative and is to be considered as an example.

The key-ring according to the invention is composed by a housing 1 provided with a fastening assembly 2, a supple string 3 which may be reinforced in the interior and rolls up in the interior of the housing by means of a strong pull-back spring, which is known as such and not shown here. The outside end of this string is integrated by a cleat 4 which is transversally crossed by a key-ring 5 with several superimposed loops for the key sets.

As an example, the string 3 rolls up around a drum in the inside, pulled into rotation by a powerful coil spring. The housing 1 is composed by a male half-shell 6 (front face) and a female half-shell 7 (rear face) closing together to form a compact assembly: the housing 1.

Each of the half-shells has a cylindrical inside volume which is crossed by the axil 8 of the drum 9 around which the string 3 is rolled up. The axil 8 is slotted to hold the end of the elastic pull-back means, in rolled-up position. It is emplaced in a central hollow 10 of the central part of the female half-shell.

Each of the half-shells has hollow pillars, as 11, containing a free conduit 12 and a thread 13 (female half-shell) respectively, for the passing of connecting elements, for instance screws, and for their anchoring.

Each half-shell has in its upper part a half-opening, as 14, with inclined edges, and a half-emplacement 15 with larger end, provided to take up, after assembly, an outlet ring 16, the lower part of the cleat 4 lying in the emplacement 14, with flared edges in the pulled-back position.

The two half-shells each contain reinforcing ribs and, in particular, the female half-shell has a circular rib 17 which limits the inner free volume and is connected with the assembly edges by extensions, as 18. This room is filled by the drum 9 and its enrolling and pull-back mechanism.

Horizontal slots as 19, of a reversed L profile with a narrow stem and a clip directed toward the center of the housing are provided on the female half-shell, and this in identical presentation on one side and the other of a middle plane which coincides with the section plane V-V. A support in right angle shape 20 is placed in the extension of the horizontal part of the stem.

The male half-shell contains opposed blocking means, as 21, composed of a projecting-stop 22 and a shoe 23 with support face 24.

On the rear face of the housing, which is normally hidden since it is in contact with the body of the guard, a fastening device has been provided, 2, to hold fast the key-ring onto an exterior plane, for instance the belt of the guard.

This device is composed essentially by a metal clasp 25 which has means for anchoring in the housing.

The clasp contains a central blade 26 in the shape of an elongated S presenting a lower loop 27, the concavity turned toward the housing, a central part 28, which is practically flat and of a considerable length, and an upper free end, curved in with the concavity turned toward the outside.

This central blade is placed between two straight lateral bands in the shape of flat narrow iron plates 30 and 31 of a frame 32, connected with each other at their upper and lower ends by the cross-pieces 33 and 34, respectively, perpendicular to the plane of the mentioned bands.

The upper cross-piece starts in set-back position, leaving the access free for the upper loop of the clasp in the width of a finger. As to the lower cross-piece, its part situated between the ends of the lateral bands 30 and 31 is continued by the blade 26.

The ends of the cross-pieces 33 and 34 are each extended by a flat lug with a hook, as 35, in the shape of an inverted L. The four lugs are identical and presented in the same way, flaps directed in the same direction.

The part between the lugs of the cross-pieces is very slightly curved toward the inside so as to match the form of the housing.

In the rest position the blade is placed with its upper part on one side of the plane of the flat irons and its lower part on the other side of the same, i.e. of the rear face of the housing.

The free end curve 29 of this blade serves as a holding organ, to hold it back from its resting position and to make it slide on an outside support. The blade is springy and therefore is right flat against the belt, strongly clamped between its rear face and the two lateral bands 30 and 31 for a simple fastening or allows the sliding of the housing on the belt when the same is introduced between the flat irons and the rear face of the housing. At this second alternative, the housing slides freely on the belt without being able to come off the same. This is the double use mentioned in the introduction.

The aforedescribed clasp is integrated with the housing by means of the hooked lugs 35, provided on the ends of the cross-pieces of the frame.

To effectuate the mounting of this clasp, the fastening device is introduced into the slots of the female half-shell, by its flat lugs. When the assembly is pulled in all the way and the edges of the cross-pieces butt against the rear face of the housing, a slight lateral movement towards the right-hand side will allow to hang up the lugs at the interior of the female half-shell. Then the two semi-shells are assembled, the projecting stops of the male half-shell will fill the slot existing between the lug and the housing. The clasp cannot move anymore and the lugs are thus locked in this position. An untimely opening is no more possible.

The drum 9 contains a bobbin 36 on the periphery of which appears a groove in which the string 3 is rolled up and a circular hollow central part 38 of a smaller diameter in which is placed the spring blade 39, rolled up in a spiral, of a constant strong pull-back power, one end 40 of which is held in the slot 8 of the axil, while the other end 41 is provided with a neck 42 which holds it in a slot provided on the periphery of the mentioned circular central part, and this independently from the fastening of the string 3 the end of which crosses the bottom of the groove, in which it is held at the other side by a knot placed at its end.

The invention was described in an exact way, however certain variants of details are possible while remaining in its framework.

What is claimed is:

1. Safety key-rings for use by prison guards, formed of two half-shells, male and female, fitting one into the other, containing in their free inside an automatic roll-up mechanism with a strong pull-back spring to the rolled-up position, the mentioned mechanism pulling with it a solid string over the upper edge of the housing, which is inseparably connected with a key-ring, characterized by the fact that the rear face of the housing has a metal attaching assembly in the shape of a clasp to hold it onto an outside plane, which clasp is safely anchored to its frame on the half-shells forming the housing, and further characterized by the fact that the metal attaching device is essentially composed by the clasp, with double purpose, containing a central blade in the shape of an elongated S, presenting a lower loop with its concave side turned toward the housing, a central part, which is practically flat, of considerable length, and a free upper part, curved in, its concave side turned toward the outside, to take up the blade, and by the fact that this blade holds onto a frame constituted by two narrow iron plates, placed longitudinally, between which is placed the blade, the flat irons being connected to each other by the cross pieces, one top the other bottom, perpendicularly to the plane of the mentioned flat irons.

2. Key-rings according to claim 1 characterized by the fact that the anchoring means of the frame at the half-shells that form the housing are constituted by two pairs of lugs in the shape of a reversed L, identical and placed in the same direction, provided on the cross pieces in the vicinity of each of their ends and being taken up in the inner structures of the two half-shells.

3. Key-rings according to claim 2 characterized by the fact that the female half-shell has on its outer face four horizontal slots placed in the same direction on each side of a transversal middle plane in the shape of inversed Ls, in which are introduced the flat lugs with the purpose of attaching the clasp, and by the fact that the male half-shell opposite the blocking organs are composed by a stop and a shoe with supporting face, to attach the lugs by locking them in the housing.

4. In a safety key-ring of the retractable reel type for use by prison guards and the like comprising a reel housing forming a compartment, a reel mechanism including a return spring mounted within the compartment and a cord connected at one end to said mechanism and extending outwardly through an edge of the compartment, the end opposite said one end being connected to a key-ring, the combination including a dual purpose attaching assembly anchored on said housing, said assembly including a clasp having a central leaf-spring blade bounded by a connected frame constituted by two narrow coplanar plate members between which the blade is positioned and a pair of cross members connecting the plate members to each other, said cross members being angularly disposed relative to the plane of the plate members and securely connected to said housing whereby the frame is held in spaced relationship to the housing for threadable mounting of a belt or the like between the housing and the frame anchored thereto.

5. In the safety key-ring of claim 4, wherein the central leaf-spring blade is connected to one of said cross members and is of S-shape to permit engagement with a belt or the like positioned between the frame and the blade.

6. In a safety key-ring of the retractable reel type for use by prison guards and the like comprising a reel housing in the form of a pair of complementary interfitting half-shells forming a compartment, a reel mechanism including a return spring mounted within the compartment, a cord connected at one end to said mechanism and extending outwardly through an edge of the housing, the end opposite said one end being connected to a key-ring, and an attaching assembly securely anchored on the housing, the combination wherein one of said half-shells is provided with a plurality of elongated slots extending in the one direction, said attaching assembly having a plurality of angular lugs located complementary to said slots, said lugs extending in said one direction for passage through said slots for engagement with the interior of said one half-shell, the other of said half-shells having a plurality of complementary blocking members adapted to be received within a portion of said slots upon assembly of said housing to prevent removal of said lugs from said slots thereby locking them in the housing.

7. In the safety key-ring of claim 6 wherein the slots include an enlarged portion for receiving said blocking member and said angular lugs are of reversed L-shape for insertion through said slots and subsequent lateral displacement in said one direction for engaging the interior of said one half-shell.

* * * * *